United States Patent [19]

Lendrihas

[11] 4,125,973

[45] Nov. 21, 1978

[54] FORM ASSEMBLY FOR BUILDING FRAMEWORK

[75] Inventor: George Lendrihas, Hackensack, N.J.

[73] Assignee: Realsources, Inc., Hackensack, N.J.

[21] Appl. No.: 781,929

[22] Filed: Mar. 28, 1977

[51] Int. Cl.[2] ..... E04B 7/02; E04B 1/14

[52] U.S. Cl. ..... 52/91; 52/252; 52/648; 52/724; 52/725; 403/171; 403/172

[58] Field of Search ..... 52/423, 91, 250, 252, 52/259, 724, 725, 303, 648; 403/172, 171; 285/424

[56] References Cited

U.S. PATENT DOCUMENTS

| | | | |
|---|---|---|---|
| 596,817 | 1/1898 | Mallen | 285/424 X |
| 650,555 | 5/1900 | Crosby | 403/172 |
| 930,160 | 8/1909 | Denny | 52/724 X |
| 1,011,195 | 12/1911 | Harry | 52/252 |
| 1,135,721 | 4/1915 | Robinson | 52/259 X |
| 1,205,132 | 11/1916 | Black | 285/424 X |
| 1,794,079 | 2/1931 | Kellett | 52/252 |
| 2,006,070 | 6/1935 | DiStasio | 52/259 |
| 2,058,135 | 10/1936 | Colville | 52/725 X |
| 2,753,962 | 7/1956 | McBerty | 52/250 X |
| 2,861,388 | 11/1958 | Favaretto | 52/250 X |
| 2,970,676 | 2/1961 | Maciunas | 52/726 X |

FOREIGN PATENT DOCUMENTS

| | | | |
|---|---|---|---|
| 145,171 | 2/1952 | Australia | 52/725 |
| 1,229,153 | 3/1960 | France | 403/171 |

*Primary Examiner*—Alfred C. Perham
*Attorney, Agent, or Firm*—Oltman and Flynn

[57] ABSTRACT

The present form assembly has sheet metal, hollow, flanged corner joints which telescopically engage the adjoining ends of elongated sheet metal forms for beams, columns, roof arches and trusses, and the like. After the parts are fitted together metal straps on the elongated forms are bent back to affix them to the corner joints, after which the interconnected corner joints and elongated forms may be filled with concrete.

14 Claims, 21 Drawing Figures

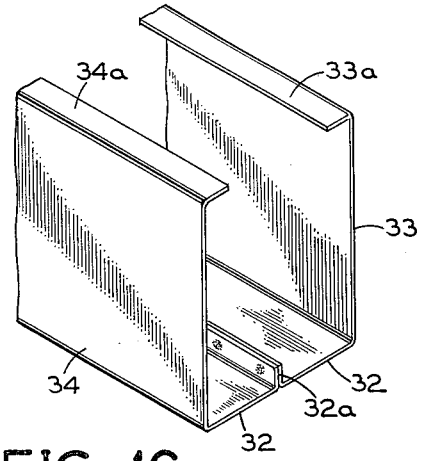
FIG. 16
FIG. 17
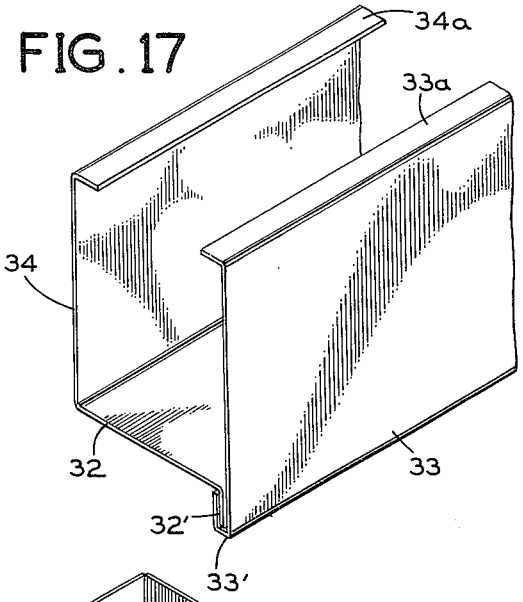
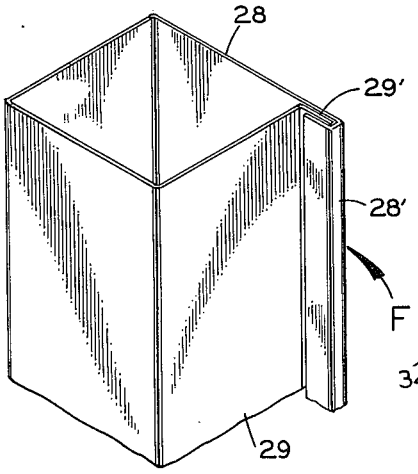
FIG. 18
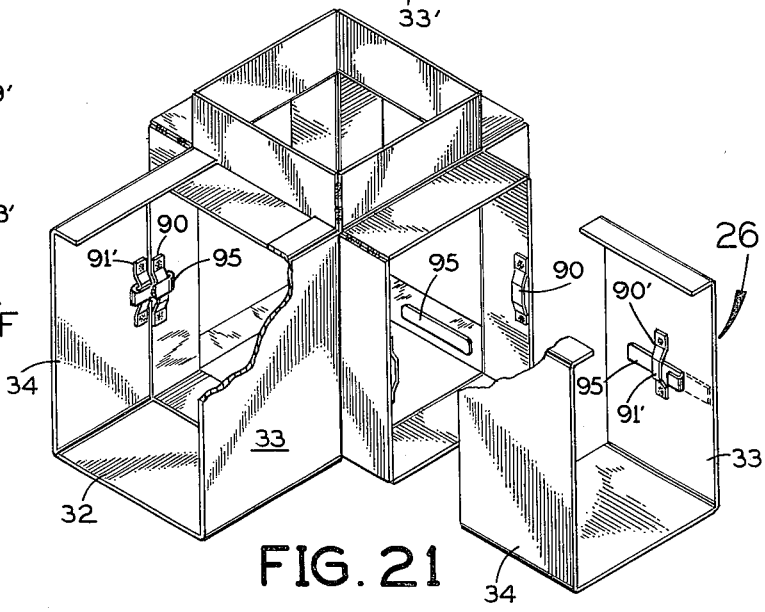
FIG. 21
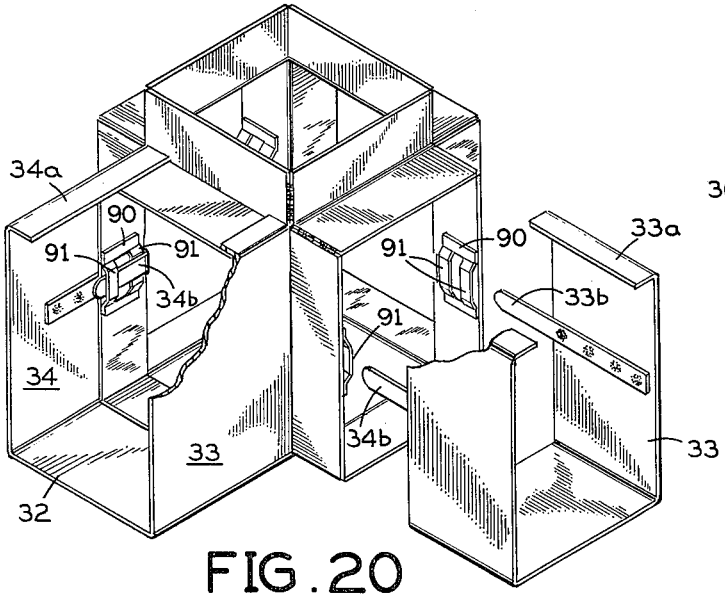
FIG. 20
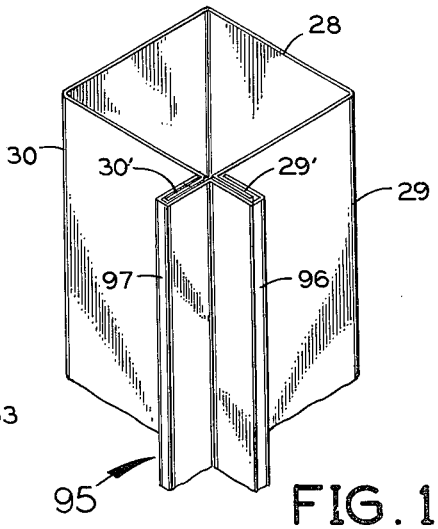
FIG. 19

FORM ASSEMBLY FOR BUILDING FRAMEWORK

SUMMARY OF THE INVENTION

This invention relates to the construction of the rigid framework of a building.

In accordance with the present invention, hollow sheet metal forms are provided for the elongated structural elements of the building framework, such as the horizontal beams, vertical columns, and inclined roof arches, trusses and the like. Also, hollow sheet metal corner joints are provided between the elongated forms for such structural elements of the framework. These corner joints have projecting flanges which have a telescopic, snug, sliding fit with the adjoining ends of the forms for the beams, columns, etc. Bendable steel straps hold these elongated forms assembled to the corner joints after they are slidably fitted together.

After their assembly, the elongated forms and the corner joints may be filled with reinforced concrete to complete the structural framework of the building. The elongated forms and corner joints remain a permanent part of the completed framework. If desired, some or all of the elongated structural elements of the completed framework, particularly the horizontal beams or the inclined roof arches or trusses, may be of wood, metal or plastic, rather than concrete.

The present invention permits the very rapid and accurate erection of all such skeleton form structures for buildings. It reduces the total amount of shoring commonly associated with poured-in-place concrete construction techniques. It eliminates all stripping of forms and the rubbing and finishing of poured concrete surfaces. It reduces heavy lift operations necessitated by conventional steel or pre-cast concrete building systems. It permits simple field attachment of hangers and fastening devices for supplementary building systems. It eliminates "blow-outs" and other similar mishaps and delays often encountered with poured-in-place construction techniques. It drastically reduces the amount of skilled field labor normally required with most field construction of such buildings and structures, and especially with poured-in-place techniques employed in conventional construction. No special tools are required.

A principle object of this invention is to provide a novel and improved sheet metal form assembly for the framework of a building.

Another object of this invention is to provide such a form assembly which greatly simplifies and economizes the completion of building frameworks.

Further objects and advantages of this invention will be apparent from the following detailed description of certain presently-preferred embodiments, which are illustrated in the accompanying drawings in which:

FIG. 2 is a perspective view of one of the outside corner joints (located at A in FIG. 1) for connecting beams and a corner column in this framework;

FIG. 3 is a perspective view of the same outside corner joint, partly inverted and turned to show certain of its structural features which do not appear as fully in FIG. 2;

FIG. 16 is a fragmentary perspective view of a beam form having a central, internal, upstanding, longitudinal, bottom rib or seam;

FIG. 17 is a fragmentary perspective view of a beam form having a bottom flange at one side;

FIG. 18 is a fragmentary perspective view of a column form having a longitudinal flange at one corner;

FIG. 19 is a similar view of a column form having two longitudinal flanges at the same corner;

FIG. 20 is a fragmentary exploded perspective view of a corner joint and two beam forms having bendable locking fingers or tabs for locking engagement with the joint; and FIG. 21 shows a modification of this corner joint.

Figure 1:
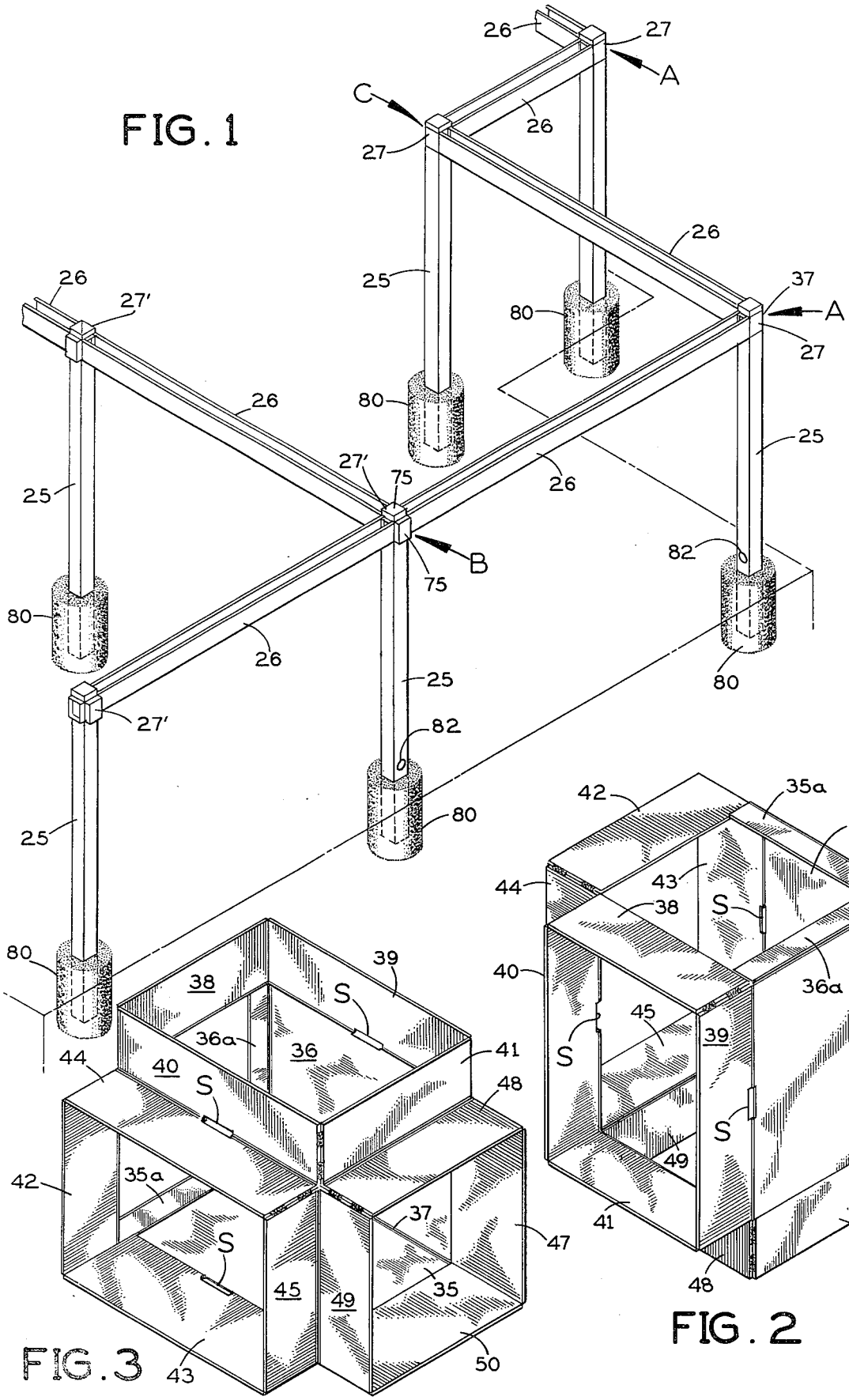
FIG. 1 is a perspective view of assembled sheet metal forms of a building framework in accordance with the present invention, before the concrete for the horizontal beams and vertical columns is added.

Referring first to FIG. 1, the framework of a building in accordance with the present invention has a plurality of elongated, hollow sheet metal forms 25 for the vertical columns, a plurality of elongated, hollow sheet metal forms 26 for the horizontal beams, and corner joints 27 and 27' at the junctures between the beams and columns.

Figures 4, 10:
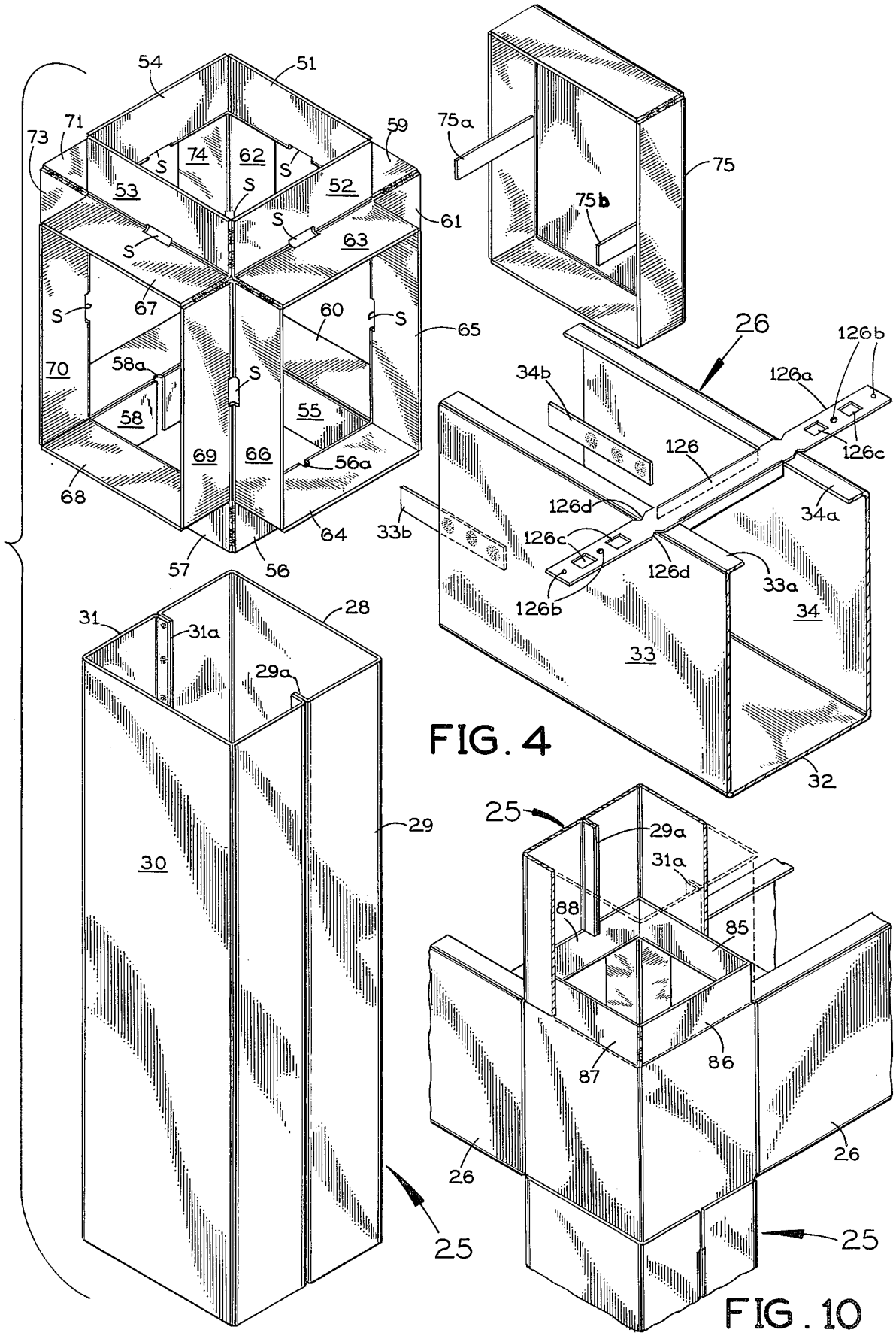
FIG. 4 is an exploded perspective view showing another corner joint (located at B in FIG. 1), a cover plate for one side of this joint, and the adjacent ends of a column form and a beam form which are connected to this joint.
FIG. 10 is a fragmentary perspective view, with certain parts shown in phantom, at the corner joint between two horizontal beam forms and two vertical column forms, one below and the other above the corner joint.

As shown in FIG. 4, each column form 25 is of square cross-section, presenting four generally flat sides 28, 29, 30 and 31. Two of the opposite sides 29 and 31 present inwardly projecting, longitudinal seams **29*a* and 31*a*, respectively. In this embodiment, the column form consists of two identical halves of rectangular, U-shaped cross-section with inturned flanges at the open side of each half which are welded to each other to provide the internal seams 29*a* and 31*a***.

Also as shown in FIG. 4, each horizontally elongated beam form 26 may be a one-piece, sheet metal body having a flat, horizontal bottom wall 32, upstanding opposite sides 33 and 34 extending parallel to each other and perpendicular to the bottom wall, and inturned horizontal lips 33*a* and 34*a* on the upper ends of the respective sides.

A spacer 126 of generally inverted U-shaped cross-section is received snugly between the lips 33*a* and 34*a* at the top of the beam form 26 to hold its sides parallel. The spacer has flat end ties 126*a* with nail holes 126*b* and strap openings 126*c*. Either end tie can be nailed to a wood waler, or its openings 126*c* can receive steel strapping for clamping it to a reinforcement. Either end tie can be broken off at the edge notches 126*d*.

At each end the beam form 26 has bendable steel straps 33*b* and 34*b* at the inside which are welded to its respective upstanding sides 33 and 34 and project horizontally beyond the adjacent end edge of the form. These straps are slidably insert able through corresponding slots in the corner joint when the beam form is assembled to the corner joint.

As shown in FIG. 2, the joint 27 at a corner between two beam forms and one column form (the corner A in FIG. 1), is of generally box-like, rectangular configuration with two closed sides 35 and 36 and four open sides. The two closed sides are adjoining vertical sides which intersect one another at an outside corner 37 of the building framework. The two closed sides have respective inturned horizontal flanges 35*a* and 36*a* at the top which have abutting beveled edges at 37*a* in FIG. 2.

At the opposite side from the closed side 35 the corner joint presents a rectangular, outwardly projecting flange consisting of a horizontal top wall 38, opposite vertical side walls 39 and 40, and a horizontal bottom wall 41 which are welded or otherwise attached rigidly to one another at their adjoining edges. This outwardly projecting flange 38–41 is shaped complementary to the cross-section of the adjacent beam form 26 so that the end of the beam form has a snug sliding fit around the outside of this flange.

At the opposite side from the closed side 36 the joint presents a similar rectangular, outwardly projecting flange having a horizontal top wall 42, opposite vertical side walls 43 and 44, and a horizontal bottom wall 45. This projecting rectangular flange 42–45 has a snug sliding fit inside the adjacent end of the adjoining beam form 26.

The corner joint is formed with a vertically elongated slot S at the juncture between its closed side 36 and the adjoining outwardly projecting flange side wall 39, at the corner juncture between the adjoining flange side walls 40 and 44, and at the juncture between its other closed side 35 and the adjoining outwardly projecting flange side wall 43. These slots receive the respective straps 33*b* and 34*b* on the adjoining beam forms when the corner joint and beam forms are assembled to each other. After passing through the slot S the strap is bent back across the inside of the adjoining side wall of the rectangular, outwardly projecting flange on the corner joint to hold the beam form and corner joint assembled together.

At the bottom in FIG. 2 the corner joint presents a rectangular, downwardly projecting flange having vertical side walls 47, 48, 49 and 50 extending at right angles to each other and welded or otherwise rigidly joined to each other at the corners. This bottom flange is shaped complementary to the cross-section of the column form 25 so that the upper end of the column form has a snug sliding fit around the outside of this flange. The internal seams 29*a* and 31*a* are removed at the upper end of the column form 25 to permit its slidable assembly over the rectangular flange 47–50 on the bottom of the corner joint.

Figure 5:
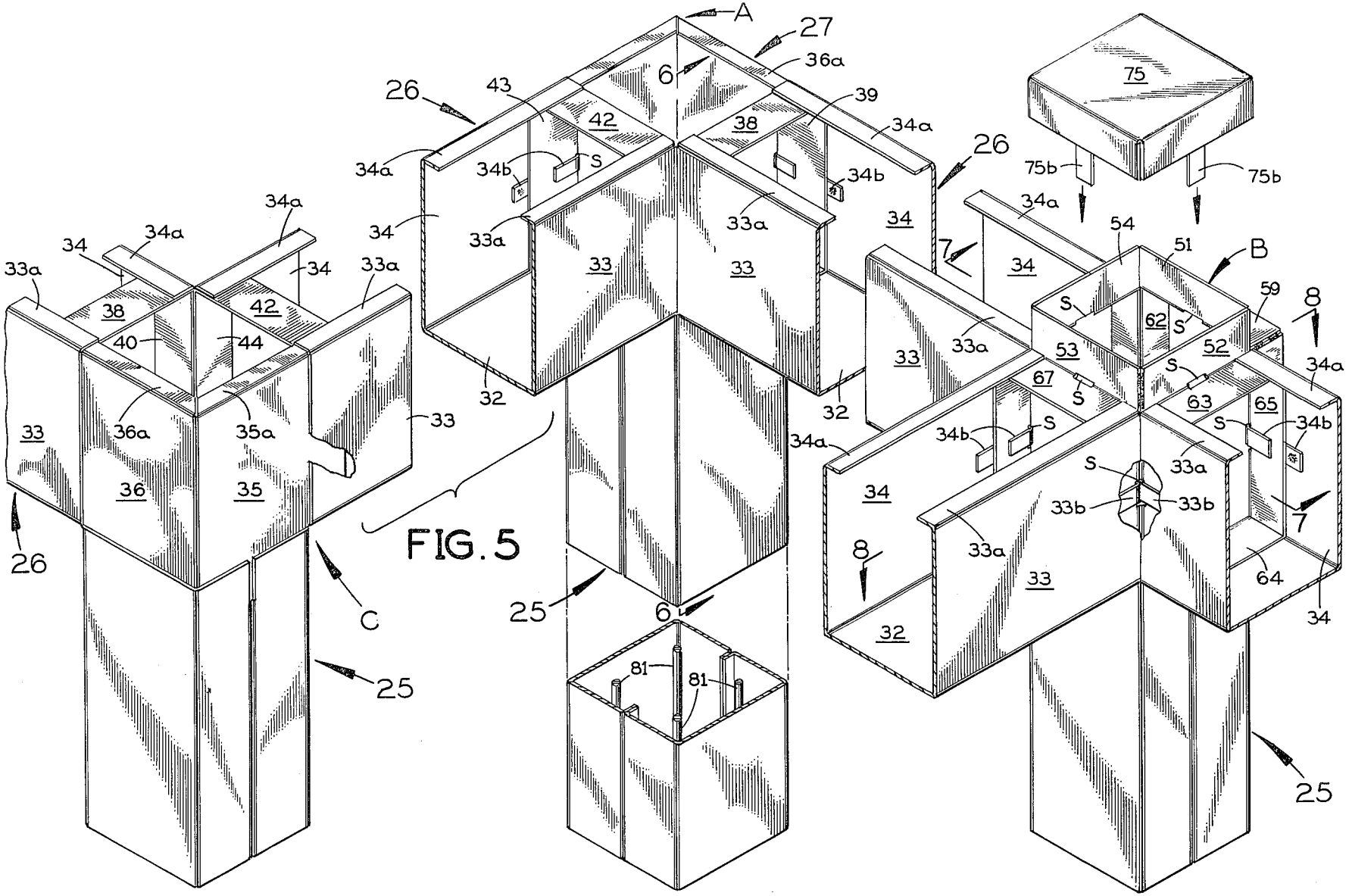
FIG. 5 is an exploded perspective view, with parts broken away, showing the corner joints between beam forms and column forms at the locations A, B and C in FIG. 1.

Referring to FIG. 5, the beam form 26 running along the front of the framework to the left of the corner A in FIG. 1 is snugly but slidably telescoped around the rectangular flange 38–41 which projects outward from that side of the corner joint. The inturned horizontal lips 33*a* and 34*a* at the top of the beam form rest on top of the top wall 38 of this flange. The sides 33 and 34 of the beam form engage the outside of the side walls 40 and 39, respectively, of this corner joint. The bottom wall 32 of the beam form engages the bottom wall 41 of the flange on the corner joint from below. The straps 33*b* and 34*b* on this end of the beam form pass through the corresponding slots S in the corner joint when the parts are fitted together and then these straps are bent back across the inside of the adjoining flange side walls 40 and 39 of the corner joint.

The beam form 26 which runs rearwardly from the corner A in FIG. 1 similarly fits telescopically around the outside of the projecting rectangular flange 42–45 on this side of the corner joint 27 in FIG. 5 and is attached to it by its end straps 33*b* and 34*b* in the same manner.

Figure 6:
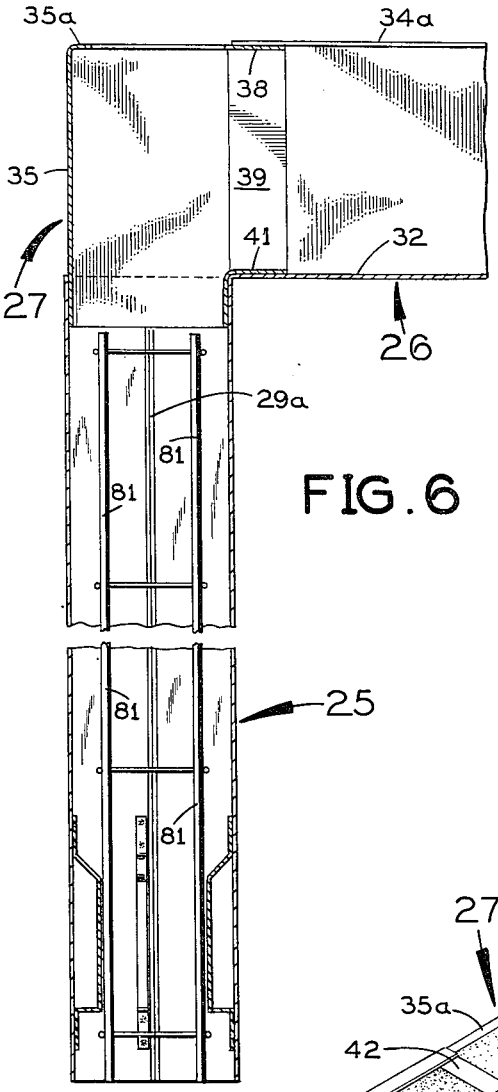
FIG. 6 is a fragmentary vertical section taken along the line 6—6 in FIG. 5.
Figure 7:
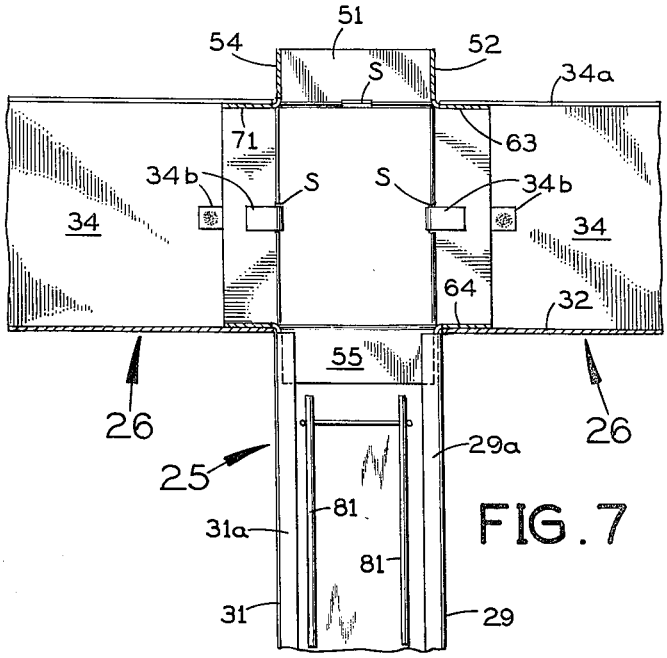
FIG. 7 is a fragmentary horizontal section taken along the line 7—7 in FIG. 5.
Figure 8:
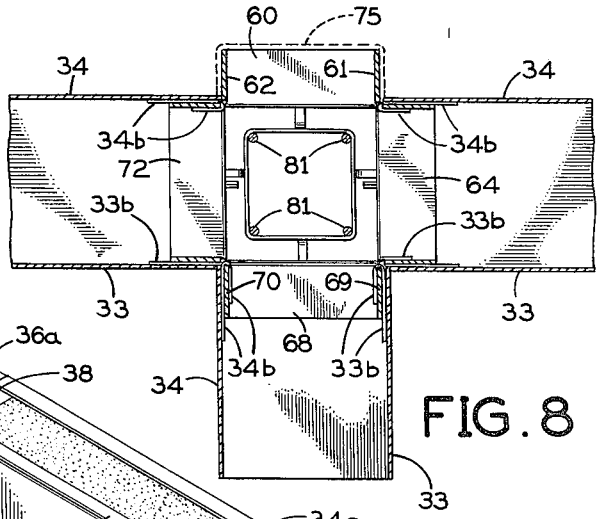
FIG. 8 is a fragmentary horizontal section taken along the line 8—8 in FIG. 5.

The upper end of the column form 25 at the corner A in FIG. 1 snugly but slidably receives the downwardly projecting rectangular flange 47–50 on the corner joint 27. The top edge of this column form engages beneath the bottom walls 41 and 39 of the projecting flanges on two adjoining sides of the corner joint, as partly shown in FIG. 6.

At the corner C in FIGS. 1 and 5 the two beam forms 26 and the column form fit around the corresponding rectangular flanges on the joint 27 in the same manner as at the corner A.

At the location B in FIGS. 1 and 5 a slightly different corner joint 27′, as shown in FIG. 4, is provided. This corner joint has a rectangular outwardly projecting flange at each of its peripheral "sides" (all of which are open sides). Thus, as shown in this Figure, at the top side of this joint 27′ a rectangular, upwardly projecting flange is provided, having four interconnected vertical walls 51, 52, 53 and 54 at right angles to each other. At the bottom the joint presents a downwardly projecting, rectangular flange having four similar vertical walls 55, 56, 57 and 58. At one vertical side the joint has a rectangular, outwardly projecting flange with horizontal top and bottom walls 59 and 60, and vertical side walls 61 and 62. At the next vertical side (moving clockwise in FIG. 4) the joint has an outwardly projecting, rectangular flange with horizontal top and bottom walls 63 and 64 and vertical side walls 65 and 66. At the next vertical side the joint has an outwardly projecting, rectangular flange with horizontal top and bottom walls 67 and 68 and vertical side walls 69 and 70. At the remaining vertical side the joint has an outwardly projecting, rectangular flange with horizontal top and bottom walls 71 and 72 and vertical side walls 73 and 74.

At the right-angled corner between the upstanding wall 52 of the top flange 51–54 and the top wall 63 of the side flange 63–66, a rectangular slot S is provided. A similar slot S is provided at each corner intersection of the following pairs of adjoining flange walls: 53 and 67;

54 and 71; 51 and 59; 61 and 65; 66 and 69; 70 and 73; and 74 and 62.

Three of the outwardly projecting flanges 63–66, 67–70 and 71–74 on the vertical sides of the corner joint are snugly received in the adjacent ends of beam forms 26, as shown in FIG. 1 at B. Each of these beam forms has a pair of end straps 33*b* and 34*b* which pass through the respective vertical slots S in the corner joint and then are bent back across the inside of the adjoining side wall of the projecting flange on the corner joint, as already described.

The two vertical slots S on opposite sides of the fourth outwardly projecting flange 59–62 on the corner joint 27′ slidably receive similar straps 75*a* and 75*b* on the inner end of a sheet metal cover 75, which closes this side of the corner joint at B, as shown in FIG. 1.

The four horizontal slots S located around the bottom of the upwardly projecting rectangular flange 51–54 on the top of the corner joint 27′ receive similar straps on the lower end of a similar cover 75, as shown in FIG. 5. Alternatively, such straps may be provided on the lower end of a column form (not shown), which would extend up from this corner joint in a multi-story building framework.

Referring to FIG. 1, concrete 80 can be poured into pits dug in the ground at each location of a vertical column form 25 for the building framework, and before this concrete has solidified the column forms may be positioned vertically with their lower ends embedded in the concrete. Reinforcing rods 81 extend down through the interior of the column forms, as shown in FIGS. 5–8. Any suitable arrangement may be provided for positioning these reinforcing rods inside the column forms. Either before or after the assembly of the corner joints 27 and 27′ and the beam forms 26 at the upper ends of the column forms, the latter may be filled with concrete which is pumped in through openings 82 located near their lower ends. Because the column forms 25 are filled with concrete from the bottom up, there is substantially no tendency for air pockets to form. The corner joints and the beam forms can be filled with concrete from the top without any appreciable problem with air pockets because these structural elements are shallow vertically.

Figure 9:
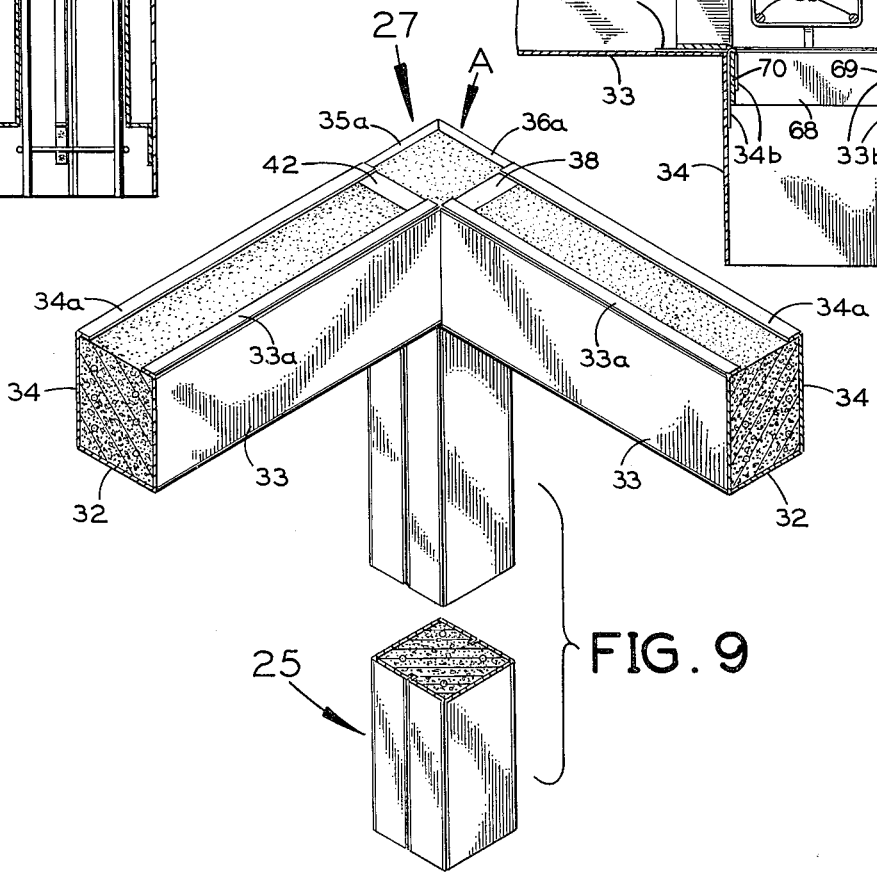
FIG. 9 is a fragmentary perspective view, partly broken away, showing the corner joint (shown at A in FIG. 1) between two beams and a column after the concrete has been added in the beam and column forms.

FIG. 9 shows the finished concrete-filled column, beam forms and corner joint at the corner A in FIG. 1.

FIG. 10 shows a corner joint which is basically the same as the corner joint 27, shown in detail in FIGS. 2 and 3, except that it also has an upwardly projecting rectangular flange at the top. This flange consists of four interconnected vertical side walls 85, 86, 87 and 88. This top flange is snugly but slidably received inside the lower end of a column form 25 which extends up from this corner joint. The lower ends of the internal seams 29*a* and 31*a* on this upper column form are cut away to accommodate the walls 86 and 88 of the top flange on this corner joint.

It will be evident that the FIG. 10 corner joint interconnects upper and lower vertical column forms 25 and two horizontal beam forms 26 extending at right angles to each other at the floor level between these two column forms.

An alternative arrangement for strapping horizontal beam forms 26 to a corner joint is shown in FIG. 20. As shown here, each vertical side wall of each outwardly projecting rectangular flange on the corner joint has a plate 90 welded or otherwise rigidly attached to it which presents two laterally inwardly offset segments 91. These offset segments 91 are spaced apart from each other in a direction away from the outer edge of the rectangular flange. Each of these offset segments 91 and the flange side wall behind it defines an opening for slidably passing the respective strap 33*b* or 34*b* on the end of the respective beam form, after which these straps may be folded back across the inside of the rear offset segment 91 and fitted snugly behind the front offset segment 91, as shown at the left in FIG. 20, to hold the beam form and the corner joint assembled together.

If desired, one or more of the horizontal beam forms may have the modified construction shown in FIG. 16, with an internal longitudinal seam 32*a* at its bottom wall. It will be evident that, like the column form shown in FIG. 4, this beam form consists of identical opposite halves which are welded together at short upturned flanges on the bottom which provide the central internal seam 32*a*.

FIG. 17 shows still another modified beam form in which one side wall 33 has an integral longitudinal, narrow, rectangular channel 33′ along the bottom. The opposite side wall 34 of the beam is integral with the bottom wall 32, and the bottom wall has a depending lip 32′ snugly received in the channel 33′ and forming therewith a rigid depending flange which extends down as a vertical continuation of the side wall 33 below the bottom wall 32. The depending lip 32′ and the channel 33′ are welded to each other so that the entire beam form is a rigid unitary structure. This flange along the bottom of the beam form facilitates the attachment of a curtain wall and fenestration with a water-tight seal.

FIG. 18 shows a similar flange construction of the column form. One side wall 28 of the column form has an integral outwardly offset, longitudinal, narrow, rectangular channel 28′ which snugly receives, and is welded to, an outwardly projecting lip 29′ on the adjoining side wall 29 of this form.

FIG. 19 shows still another modification of the column form having two adjoining flanges extending perpendicular to one another along one corner of the form. Two of the adjoining side walls 29 and 30 of this column form are provided with integral lips 29′ and 30′, respectively, which extend perpendicularly out from these side walls where they come together at one corner of the column form. A one-piece sheet metal connecting piece 95 presents narrow rectangular channels 96 and 97, respectively, which snugly receive these lips 29′ and 30′ and are welded to them to provide a rigid, unitary structure.

Figure 11:
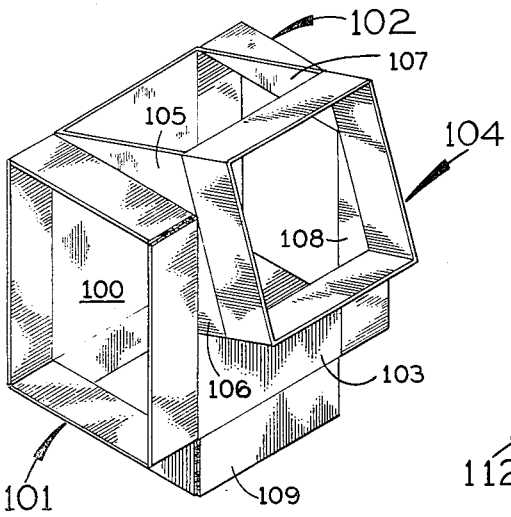
FIG. 11 is a perspective view of a joint (at D in FIG. 14) for use with a roof truss, a column and two beams aligned with each other on opposite sides of this joint.
Figure 14:
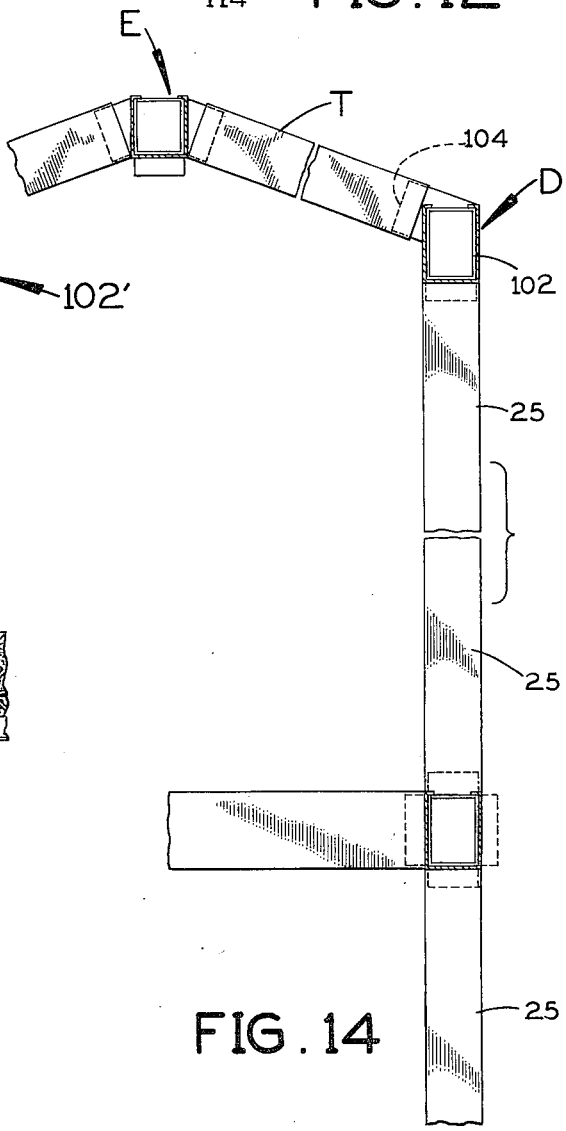
FIG. 14 is a vertical elevation showing part of a building framework which includes the joints of FIGS. 11 and 12.

FIG. 11 depicts a corner joint as shown at the corner D in FIG. 14, where the upper end of column form and beam forms are connected to an upwardly inclined roof truss T. This joint presents a closed vertical back wall 100, an outwardly projecting rectangular flange 101 at the left side of this back wall for attachment to a horizontal beam form, as already described, a similar outwardly projecting rectangular flange 102 at the opposite side for the same purpose, and a downwardly projecting rectangular flange 109 on the bottom for attachment to the upper end of a column form as described. At the front side in FIG. 11 (between the outwardly projecting flanges 101 and 102), this joint presents a closed vertical wall 103 which extends only about half-way up this side. Above this front wall the corner joint presents an outwardly facing, upwardly inclined rectangular flange 104 which is rigidly attached to the side flange 101 by triangular vertical walls 105 and 106 and is rigidly attached to the opposite side flange 102 by triangular walls 107 and 108.

The upwardly inclined rectangular flange 104 is snugly but slidably received telescopically in the complementary lower end of the roof truss T as shown schematically in FIG. 14. The rectangular side flanges 101 and 102 are similarly received snugly in horizontal beam forms and the rectangular bottom flange 109 is received with a snug, sliding fit in the upper end of the vertical column form 25 in FIG. 14 in the manner already described in detail.

Figure 12:
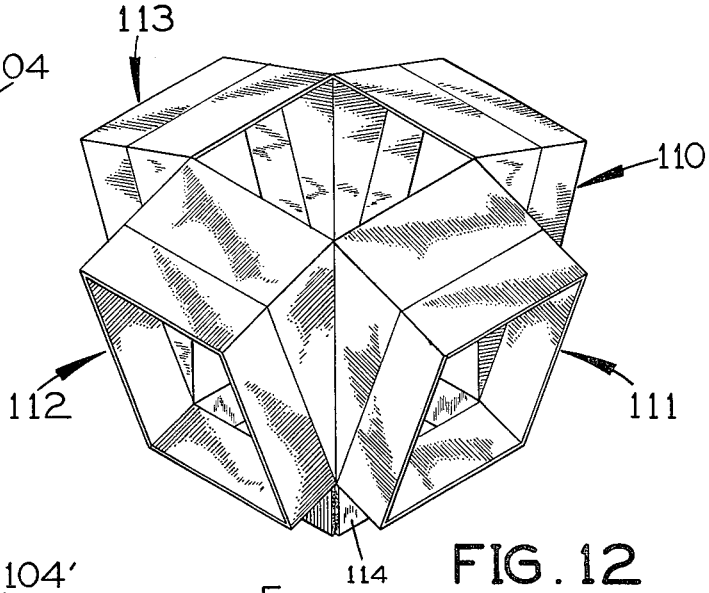
FIG. 12 is a perspective view of a joint (at E in FIG. 14) for connecting the upper ends of four roof truss forms.

FIG. 12 illustrates the peak corner joint shown at E in FIG. 14. This joint presents four downwardly inclined, outwardly facing, rectangular flanges 110, 111, 112 and 113 and a rectangular bottom flange 114 all connected together in a rigid sheet metal structure. The bottom flange 114 is attachable to the upper end of a vertical column 25 and the downwardly inclined flanges 110–113 are attachable individually to corresponding inclined roof supporting arches or truss members.

Figure 13:
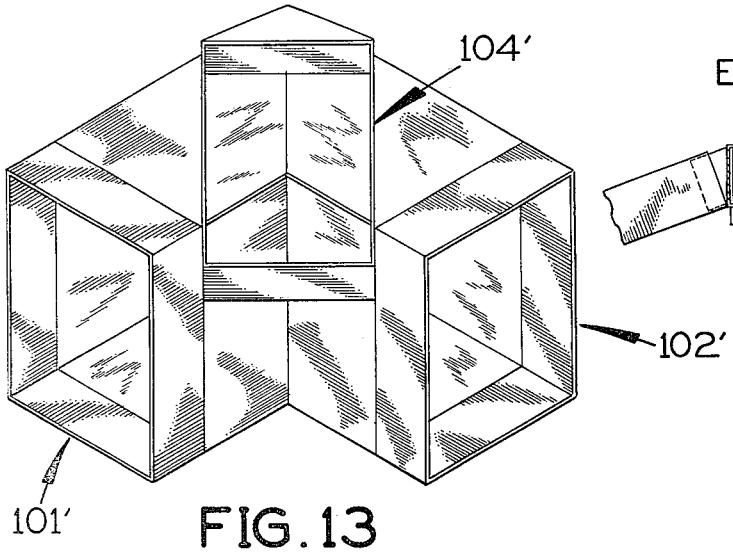
FIG. 13 is a perspective view of a joint for connection to a roof arch or truss at a corner between two beams.

FIG. 13 shows a corner joint generally similar to that of FIG. 11 except that it is designed for attachment to horizontal beams which extend perpendicular to each other. Elements of the FIG. 13 joint which correspond to those in the FIG. 11 joint are given the same reference numerals, with a "prime" suffix added, and these elements need not be described again in detail. The upwardly inclined rectangular flange 104' bisects the inside corner of this joint.

Figure 15:
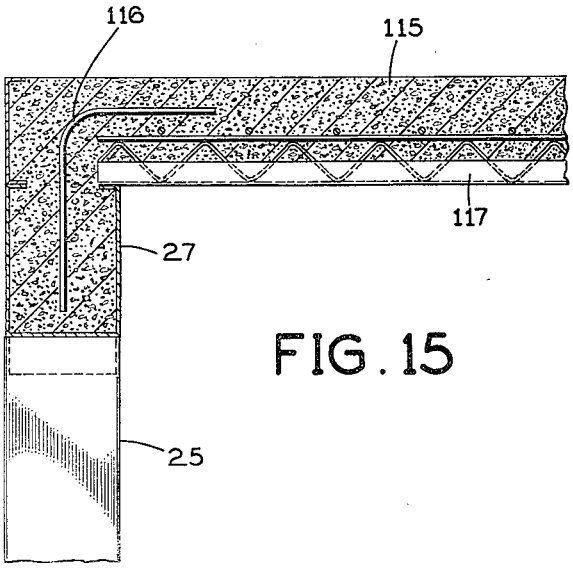
FIG. 15 is a vertical section showing the completed assembly of a column, corner joint and floor slab using the assembled forms of the present invention.

FIG. 15 shows a concrete floor 115 where it is attached to a concrete-filled corner joint 27 on the upper end of a concrete-filled column form 25. Reinforcing rods 116 are bent at right angles to extend vertically down into the corner joint 27 and horizontally into the poured concrete in the floor slab 115 to tie the floor slab to the corner joint. A filigree plank rests at one end on top of the corner joint 27 to provide a base for the concrete floor slab 115.

FIG. 21 shows another arrangement for strapping a beam form to a corner joint. Here, the beam form 26 has a plate 90' welded to the inside of each of its upstanding sides. This plate has an inwardly offset segment 91' at the middle which is closely spaced from the adjoining side wall of the beam form to pass a sheet metal strap 95. One end of this strap is folded tightly around the offset segment 91' of plate 90' on the beam form. The opposite end of the strap can be assembled to the plate on the adjacent corner joint flange in the manner already described with reference to FIG. 20. With this arrangement, it it not necessary to weld the strap to the beam form.

It is to be understood that various structural modifications and adaptation of the disclosed assembly may be adopted without departing from the teaching of this invention. For example, overhanging cantilevered beams may be attached to corner joints at the outside of the building framework. Also, various arrangements for clamping the elongated forms to the corner joints, other than the disclosed strapping arrangements, may be provided.

I claim:

1. In a sheet metal form assembly for a building framework having:

a plurality of adjoining, horizontally elongated, sheet metal beam forms extending away from a corner joint location, each of said beam forms having a closed bottom and opposite upstanding sides and being open at the top to receive poured concrete for filling the interior of the beam form;

a vertically elongated, sheet metal, hollow column form extending down from said corner joint location, said column form having a closed periphery along its vertical length and being open at the top to receive poured concrete for filling the hollow interior of the column form;

the improvement which comprises a sheet metal, hollow, corner joint engaged between and connecting the upper end of the column form and the neighboring ends of the beam forms at said corner joint location, said corner joint having side openings therein which are aligned respectively with the neighboring ends of the beam forms and a bottom opening which is aligned with the upper end of the column form, said corner joint having a top opening and being open at the inside below said top opening between said side and bottom openings for receiving concrete poured down into said top opening, said corner joint having outwardly projecting flanges at the periphery of each of said side and bottom openings which slidably interfit telescopically with the adjacent ends of the ajoining beam forms and the column form, respectively.

2. A form assembly according to claim 1, wherein:

said corner joint has adjoining vertical sides which meet at corners and has vertically elongated slots at said corners;

and each beam form at its end next to the corner joint has longitudinally projecting straps which are slidably received respectively in said slots and are bendable across the inside of the corresponding corner of the corner joint to anchor the beam form to the corner joint.

3. A form assembly according to claim 1, wherein:

each beam form has inturned horizontal top lips at the respective upper ends of its opposite sides and on opposite sides of the top opening in said beam form;

the flanges on the corner joint at the periphery of each side opening extend snugly inside the bottom, sides and inturned top lips on the adjoining beam form;

and the flanges on the corner joint at the periphery of its bottom opening extend snugly inside the periphery of the column form at the latter's upper end.

4. A form assembly according to claim 3, wherein:

the flanges on the corner joint at each side opening therein include a pair of opposite vertical side flanges;

and further comprising:

plate means on the inside of each of said opposite vertical side flanges defining a slot which leads into the interior of the corner joint;

and longitudinally projecting straps on the opposite sides of each beam form at its end next to the corner joint, said straps being slidably inserted through said last-mentioned slots and bendable across the inside of the respective plate means to anchor the respective beam form to the corner joint.

5. A form assembly according to claim 3, wherein:

the flanges on the corner joint at each side opening therein include a pair of opposite vertical side flanges;

and further comprising:

plate means on the inside of each of said opposite vertical side flanges defining a slot which leads into the interior of the corner joint;

similar plate means on the inside of the corresponding side of the adjoining beam form presenting a slot which is aligned with said first-mentioned slot at the corner joint;

and longitudinally projecting straps slidably inserted through said aligned slots and bendable across the inside of the respective plate means to anchor the respective beam form to the corner joint.

6. A form assembly according to claim 3, and further comprising a rigid spacer resting on the top lips of at least one of the beam forms, said spacer having depending portions which are snugly received between the inner edges of said top lips at the opposite sides of the top opening in said beam form.

7. A form assembly according to claim 6, wherein said spacer is of substantially inverted U-shaped cross-section between said top lips.

8. A form assembly according to claim 7, wherein said spacer has flat end ties extending beyond the respective sides of the underlying beam form, and said spacer has notches in its opposite peripheral edges at the respective sides of the underlying beam form to facilitate bending down said end ties to extend along said sides of the respective beam form at the outside of the latter.

9. A form assembly according to claim 8, wherein said end ties on the spacer have strap openings therein.

10. A form assembly according to claim 8, wherein said end ties have nail holes therein.

11. A form assembly according to claim 3, wherein said corner joint has upwardly projecting flanges at the periphery of its top opening.

12. A form assembly according to claim 11, wherein said corner joint presents corner intersections between said upwardly projecting flanges and said outwardly projecting flanges at its sides and has slots at said corner intersections, and further comprising:

a cover which fits slidably over the top of said upwardly projecting flanges on the corner joint, said cover having depending straps which are slidably received in said slots and are bendable to anchor the cover to the corner joint.

13. A form assembly according to claim 3, wherein said corner joint has inturned horizontal lips at peripheral edges of its top opening.

14. A form assembly according to claim 3, wherein said corner joint has an upwardly and outwardly inclined opening located between two of its side openings, and the corner joint has outwardly projecting flanges at the periphery of said inclined opening for slidably receiving a roof beam.

* * * * *